US009089181B1

(12) United States Patent
Sigle

(10) Patent No.: US 9,089,181 B1
(45) Date of Patent: Jul. 28, 2015

(54) HEADWEAR WITH QUICK ACCESS POCKET

(71) Applicant: Qick Pick LLC, Nashville, TN (US)

(72) Inventor: Luke William Sigle, Nashville, TN (US)

(73) Assignee: QickPick, LLC, Nashville, TN (US)

( * ) Notice: Subject to any disclaimer, the term of this patent is extended or adjusted under 35 U.S.C. 154(b) by 0 days.

(21) Appl. No.: 14/291,697

(22) Filed: May 30, 2014

Related U.S. Application Data

(60) Provisional application No. 61/962,901, filed on Nov. 19, 2013.

(51) Int. Cl.

| | |
|---|---|
| ***A42B 1/24*** | (2006.01) |
| ***A42B 1/18*** | (2006.01) |
| ***A42B 1/22*** | (2006.01) |
| ***A42B 1/06*** | (2006.01) |

(52) U.S. Cl.
CPC ..... *A42B 1/241* (2013.01); *A42B 1/061* (2013.01); *A42B 1/18* (2013.01); *A42B 1/22* (2013.01); *A42B 1/248* (2013.01)

(58) Field of Classification Search
CPC ..... A42B 1/248; A42B 1/22; A42B 1/061; A42B 1/062
USPC ..... 2/195.2, 10, 195.4, 195.5, 195.6
See application file for complete search history.

(56) References Cited

U.S. PATENT DOCUMENTS

| | | | | |
|---|---|---|---|---|
| 1,569,658 | A * | 1/1926 | Levinson | 2/10 |
| 2,744,256 | A * | 5/1956 | Slotkin et al. | 2/209.13 |
| 3,337,877 | A * | 8/1967 | Lipkin | 2/172 |
| 5,233,703 | A * | 8/1993 | Galka | 2/209.13 |
| 5,271,099 | A * | 12/1993 | Lin | 2/10 |
| 5,410,761 | A * | 5/1995 | Connelly et al. | 2/195.1 |
| 5,781,933 | A * | 7/1998 | De Giacomi | 2/195.1 |
| D417,334 | S | 12/1999 | Wands | |
| D438,366 | S | 3/2001 | Park | |
| 6,314,583 | B1 | 11/2001 | Cho | |
| 6,357,051 | B1 * | 3/2002 | Lee | 2/195.1 |

(Continued)

FOREIGN PATENT DOCUMENTS

KR 300707828-0000 8/2013

OTHER PUBLICATIONS

Hyp Wavy Split-Color Bill Cap (on-line), dated Jan. 3, 2011. Retrieved from Internet Nov. 3, 2014, URL: http//www.jiffyshirts.com/hyp-A4016.htlm (2 pages).

(Continued)

*Primary Examiner* — Shaun R Hurley
*Assistant Examiner* — Bao-Thieu L Nguyen
(74) *Attorney, Agent, or Firm* — Nathan J. Bailey; Blake M. Bernard; Waller Lansden Dortch & Davis

(57) ABSTRACT

A headwear apparatus including a crown. A visor can extend outward from the crown, the visor having an outer peripheral edge. An outer visor layer can cover at least a portion of the visor. A visor pocket can be defined between the outer visor layer and the visor, the visor pocket including an opening defined in the outer visor layer, the visor pocket oriented with the opening positioned toward the outer peripheral edge of the visor. In some embodiments, the opening in the visor pocket can be located proximate the outer peripheral edge of the visor to allow for easy access to the visor pocket. In some embodiments, a fastener can connect the outer visor layer to the visor, the fastener defining the visor pocket.

15 Claims, 6 Drawing Sheets

(56) References Cited

U.S. PATENT DOCUMENTS

| | | | | |
|---|---|---|---|---|
| 6,449,773 | B1 | 9/2002 | Shwartz et al. | |
| D469,242 | S | 1/2003 | Park | |
| 6,557,180 | B2 | 5/2003 | Hall McKenzie | |
| RE38,160 | E | 7/2003 | Soergel | |
| 6,643,847 | B1 * | 11/2003 | Dornak | 2/195.1 |
| D488,293 | S | 4/2004 | Norway, Jr. | |
| D521,211 | S | 5/2006 | Park | |
| D529,748 | S | 10/2006 | Park | |
| 7,191,702 | B2 | 3/2007 | Kercher | |
| D571,539 | S | 6/2008 | Valcourt | |
| D582,634 | S | 12/2008 | Lagassey | |
| 7,636,954 | B2 * | 12/2009 | Lang-Ree et al. | 2/422 |
| D634,102 | S | 3/2011 | Smith | |
| 7,904,970 | B2 * | 3/2011 | Thomas | 2/209.13 |
| 8,051,497 | B1 * | 11/2011 | Erhardt | 2/175.6 |
| D659,351 | S | 5/2012 | Benkendorfer | |
| 8,191,175 | B1 * | 6/2012 | White | 2/175.5 |
| D669,252 | S | 10/2012 | Rogers | |
| D679,074 | S | 4/2013 | Goico Morales | |
| D699,928 | S | 2/2014 | Tien | |
| D705,527 | S | 5/2014 | Clark | |
| D713,622 | S | 9/2014 | Steel | |
| 2003/0041367 | A1 * | 3/2003 | Hadden et al. | 2/195.5 |
| 2003/0226193 | A1 * | 12/2003 | Wang | 2/195.6 |
| 2004/0210982 | A1 * | 10/2004 | Kronenbeger | 2/171 |
| 2006/0206985 | A1 | 9/2006 | Proctor | |
| 2009/0205109 | A1 | 8/2009 | Butler | |
| 2009/0260131 | A1 | 10/2009 | Kim | |
| 2009/0265837 | A1 | 10/2009 | Cunliffe | |
| 2010/0083421 | A1 * | 4/2010 | Cho | 2/171.2 |
| 2011/0094014 | A1 | 4/2011 | Chang | |
| 2011/0283430 | A1 * | 11/2011 | Divine et al. | 2/6.6 |
| 2012/0192337 | A1 * | 8/2012 | Divine et al. | 2/414 |

OTHER PUBLICATIONS

MovieMax wave visor (on-line), dated Jun. 29, 2013. Retrieved from Internet Nov. 3, 2014, URL: https://www. iaspromotescom/802-15555-10543945-promotional-items-caps-hats-&-headwear-visors.htm (1 page).

Co-pending U.S. Appl. No. 29/492,374.

* cited by examiner

HEADWEAR WITH QUICK ACCESS POCKET

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application claims benefit of the following patent application which is hereby incorporated by reference: Ser. No. 61/962,901 filed Nov. 19, 2013 for Headwear Quick Access Pocket.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to headwear such as caps, hats, and visors. Such headwear can be worn during sporting, recreational, or leisure activities. During such activities, a user of the headwear often is limited in the ability to store personal items on the user's person. It would be convenient if the user could store such items on headwear.

More particularly, this invention pertains to headwear that includes a pocket to store personal items. While there are current solutions that include pockets at different positions on headwear, these solutions are inadequate as the pockets are inconveniently placed and oriented on the headwear such that it is difficult for the user to access the pocket. In some current solutions, the headwear has to be removed entirely from the user's head in order to gain access to the pockets.

What is needed, then, are improvements in headwear that can provide a quick access pocket for a user to store and quickly access personal items on the headwear.

BRIEF SUMMARY OF THE INVENTION

One aspect of the present invention is a headwear apparatus which includes a crown. A visor extends outward from the crown, the visor having an outer peripheral edge. An outer visor layer covers at least a portion of the visor. A visor pocket can be defined between the outer visor layer and the visor, the visor pocket including an opening defined in the outer visor layer. The visor pocket can be oriented with the opening positioned toward the outer peripheral edge of the visor. In some embodiments, the opening in the visor pocket is located proximate the outer peripheral edge of the visor such that the opening and the visor pocket can be quickly located and an object can be inserted into the pocket.

In another aspect of the present invention, the headwear apparatus includes a crown and a visor extending outward from the crown. The visor can have an upper surface and an outer peripheral edge. An outer fabric can cover at least a portion of the upper surface of the visor. A visor pocket can be defined between the upper surface of the visor and the outer fabric, the visor pocket including an opening defined in the outer fabric. The visor can be oriented with the opening positioned toward the outer peripheral edge of the visor.

Another aspect of the present invention is a headwear apparatus including a crown and a visor extending outward from the crown, the visor including an outer peripheral edge. An outer visor layer covers at least a portion of the visor. A fastener connects the outer visor layer to the visor, the fastener forming a visor pocket between the outer visor layer and the visor. An opening is defined in the outer visor layer, the opening extending into the visor pocket. The visor pocket is oriented with the opening positioned toward the outer peripheral edge of the visor. In some embodiments, the fastener is a stitch.

One objective of the present invention is to provide a quick access pocket on a headwear apparatus.

Another objective of the present invention is to be able to store items of different shapes and sizes on a headwear apparatus.

DETAILED DESCRIPTION OF THE INVENTION

While the making and using of various embodiments of the present invention are discussed in detail below, it should be appreciated that the present invention provides many applicable inventive concepts that is embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and the are not intended to refer to only a singular entity, but rather include the general class of which a specific example may be used for illustration. The terminology herein is used to describe specific embodiments of the invention, but their usage does not delimit the invention, except as set forth in the claims.

As described herein, an upright position is considered to be the position of apparatus components while in proper operation or in a natural resting position as described herein. Vertical, horizontal, above, below, side, top, bottom and other orientation terms are described with respect to this upright position during operation unless otherwise specified. The term "when" is used to specify orientation for relative positions of components, not as a temporal limitation of the claims or apparatus described and claimed herein unless otherwise specified. The term "lateral" denotes a side to side direction when facing the "front" of an object.

Figure 1:
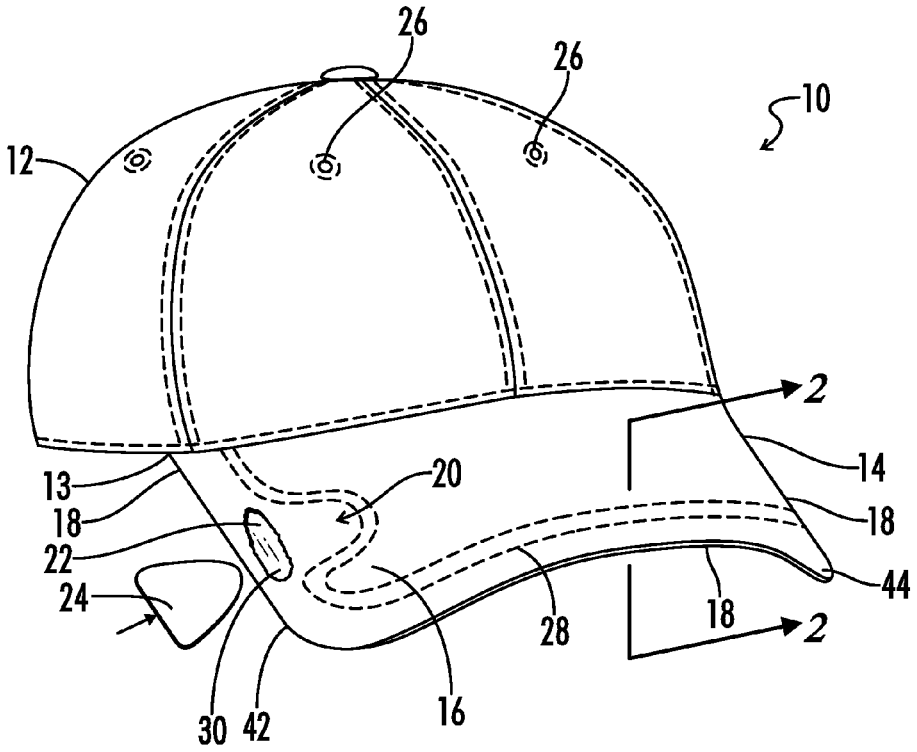
FIG. 1 is a front perspective view of a first embodiment of a headwear apparatus of the present invention.

The present invention relates generally to a headwear apparatus having a quick access pocket. One embodiment of the present invention is shown in FIG. 1. The headwear apparatus 10 includes a crown 12. A visor 14 extends outward from the crown 12. The visor 14 can generally extend from a lower periphery 13 of the crown 12 in some embodiments. An outer visor layer 16 covers at least a portion of the visor 14. The visor 14 can have an outer peripheral edge 18. The outer peripheral edge 18 can include any edges of the visor 14 that are not mated with the crown 12. In some embodiments, the visor 14 can extend outward from only a portion of the lower periphery 13 of the crown 12, similar to a traditional sports hat, sports visor, ball cap, etc. In other embodiments, the visor 14 can extend outward from an entire lower periphery 13 of the crown 12, similar to a traditional cowboy hat, bowler, sun hat, etc.

A visor pocket 20 can be defined between the outer visor layer 16 and the visor 14. The visor pocket 20 can include an opening 22 defined in the outer visor layer 16. The visor pocket 20 can be oriented with the opening 22 positioned toward the outer peripheral edge 18 of the visor 14. A personal item or object 24 can then be inserted through the opening 22 in the outer visor layer 16 such that the object 24 can be retained in the visor pocket 20. The orientation of the visor pocket 20 with the opening 22 positioned toward the outer peripheral edge 18 can allow a user to place an object 24 in the visor pocket 20 more efficiently, without the need to remove the headwear apparatus 10 from the user's head. One advantage of having a pocket 20 located on the visor 14 is that the process of inserting an object 24 into the visor can generally be seen from the periphery of a user's field of vision while the user is wearing the headwear apparatus 10.

In some embodiments, the opening 22 defined in the outer visor layer 16 can be located proximate the outer peripheral edge 18 of the visor 14. As such, the opening 22 defined in the outer visor layer 16 and extending into the visor pocket 20 can be more quickly and efficiently located by the user when inserting an object 24 into the visor pocket 20.

In some embodiments, the outer visor layer 16 can made from an elastic material such that the outer visor layer 16 can be stretched to cover the visor 14. As such, the outer layer 16 can be resilient to deformation when an object 24 is inserted through the opening 22 into the visor pocket 20. The outer visor layer 16 can then resiliently retain the object 24 in the visor pocket to help prevent the object 24 from falling out of the visor pocket 20. The resilience of the outer visor layer 16 retaining the object 24 within the pocket can help eliminate the need for a cumbersome closure mechanism such as buttons, zippers, clasps, hook and loop assemblies, or flap covers. As such, the object 24 can quickly and efficiently be selectively inserted into and removed from the visor pocket 20, while the object 24 can be prevented from falling out of the visor pocket 20 unintentionally. However, in some embodiments, the object 24 can be further secured in the visor pocket 20 by an additional pocket fastener, including but not limited to, buttons, zippers, hook and loop assemblies, or flaps closing the pocket. An elastic material may also be employed at the opening 22 of the pocket 20 to further help secure an object 24 in the pocket 20.

The outer visor layer 16 can include, among other things, any suitable fabric material, including but not limited to, cottons, nylons, felts, polyesters, elastanes, denims, wools, leathers, or silks. The fabric material may also have elastic properties such that outer visor layer 16 is resilient to deformation as previously described.

The visor 14 can be made from many different types of materials, including but not limited to, plastic, cardboard, paper, metal, or fiberglass. Such materials can provide structure or rigidity to the visor 14 such that it can retain a consistent shape. The visor 14 can also be made from a rigid but pliable material such that the shape of the visor 14 can be altered by the user. This can allow a single style of visor 14 to be manufactured while allowing the user to tailor their particular visor 14 to their preferences. For instance, the headwear apparatus 10 could be manufactured with a "basketball style" straight visor, which could then be bent by the user if they preferred to a "baseball style" curved visor 14, similar to the visor 14 shown in FIG. 1.

The visor 14 in some embodiments can also have a rough or textured outer surface. A rough or textured outer surface can provide a source of friction such that when an object is inserted into the visor pocket 20, the friction produced by the rough or textured outer surface of the visor 14 can help prevent the object 24 from falling out of the visor pocket 20. A rough or textured outer surface can be a byproduct of the material chosen for the visor 14, or the rough or textured outer surface of the visor 14 can be formed during the manufacturing process. The visor may further comprise a recess located proximate the visor pocket 20. The recess may be shaped substantially the same as the pocket 20 or the object 24 and/or otherwise be configured to hold the object 24 in place.

Figure 2:
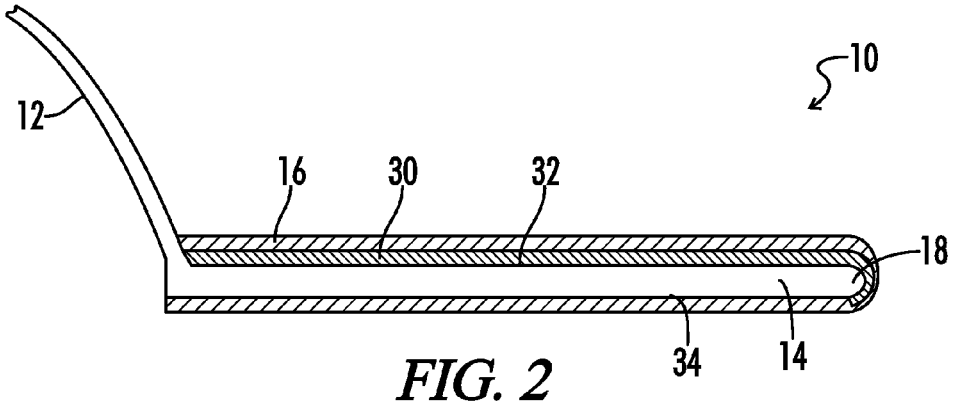
FIG. 2 is a cross sectional view of a visor of the headwear apparatus shown in FIG. 1.

In some embodiments, as shown in FIG. 1 and FIG. 2, the outer visor layer 16 can cover substantially the entire visor 14, including both an upper surface 32 and a lower surface 34 of the visor 14. Such an embodiment allows the visor pocket 20 to be formed adjacent either the upper surface 32 or the lower surface 34 of the visor 14. In other embodiments, the outer visor layer 16 can cover substantially the entire upper surface 32 of the visor 14, extend around the outer peripheral edge 18 of the visor 14, and connect to the lower surface 34 of the visor 14. In some embodiments, the outer visor layer 16 can cover only a portion of the upper surface 32 of the visor 14 to form a visor pocket 20 between the outer visor layer 16 and the visor 14. Similarly, the outer visor layer 16 in some embodiments can cover substantially the entire lower surface 34 of the visor 14, or only a portion of the lower surface 34 of the visor 14.

In some embodiments, as shown in FIG. 2, the headwear apparatus 10 can further include an inner fabric 30 positioned between the outer visor layer 16 and the visor 14. When an object 24 is then inserted through the opening 22 of the visor pocket 20, the object 24 can be retained between the inner fabric 30 and the outer visor layer 16. The inner fabric 30 can then provide friction against the object 24 which can help prevent the object 24 from falling out of the visor pocket 20. The inner fabric 30 can be of the same material as the outer visor layer 16, which can help provide a uniform appearance for the headwear apparatus 10. Additionally, as seen in FIG. 2, the inner fabric 30 can cover substantially the entire upper surface 32 of the visor 14 when the visor pocket 20 is formed adjacent the upper surface 32 of the visor 14. In other embodiments, the inner fabric 30 can cover substantially the entire lower surface 34 of the visor 14 when the visor pocket 20 is formed adjacent the lower surface 34 of the visor 14. In still other embodiments, the inner fabric 30 can be sized and shaped to cover only the portion of the visor 14 on which the visor pocket 20 is defined in an effort to minimize the amount and cost of materials.

The inner fabric 30 can include, among other things, any suitable fabric material, including but not limited to, cottons, nylons, felts, polyesters, elastanes, denims, wools, leathers, or silks. The fabric material may also have elastic properties such that the inner fabric 30 is resilient to deformation as previously described.

The crown 12 shown in FIG. 1 substantially covers the top of a user's head when the headwear apparatus 10 is worn. The crown 12 in some embodiments can include one or more vent holes 26. The vent holes 26 can allow air to circulate through the crown 12 to keep a user's head cool. In other embodiments, the crown 12 can be a strap or band that is connected around the user's head, while leaving the top of the user's head uncovered, similar to conventional sports visors.

The headwear apparatus 10 of FIG. 1 includes a fastener 28 connecting the outer visor layer 16 to the visor 14. The fastener 28 can be configured to define the visor pocket 20 around the opening 22 in the visor outer layer 16. The fastener 28 can be any suitable fastener, including but not limited to, stitching, molding, fusing, adhesives, heat inlay, or other mechanical fasteners. The fastener 28 can help reduce the size of the visor pocket 20 such that the outer visor layer 16 can produce a tighter fit over the object 24 being inserted into the visor pocket 20, thus helping prevent the object 24 from falling out of the visor pocket 20. Additionally, the fastener 28 can help contain the object 24 inserted into the visor pocket 20 to a more fixed location on the visor 14. In FIG. 1, the fastener 28 is a stitch that is woven into the outer visor layer 16 and the visor 14. The stitch 28 can define the visor pocket 20 and provide a visible indication to the user of the location and shape of the visor pocket 20.

Figure 3:
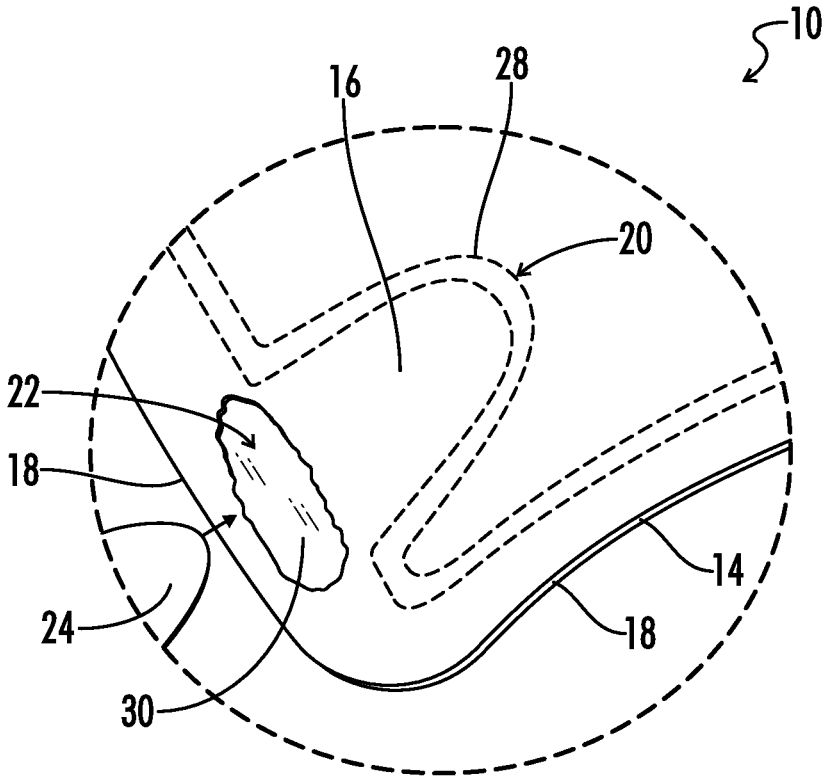
FIG. 3 is a detailed view of a visor pocket of the headwear apparatus shown in FIG. 1.
Figure 4:
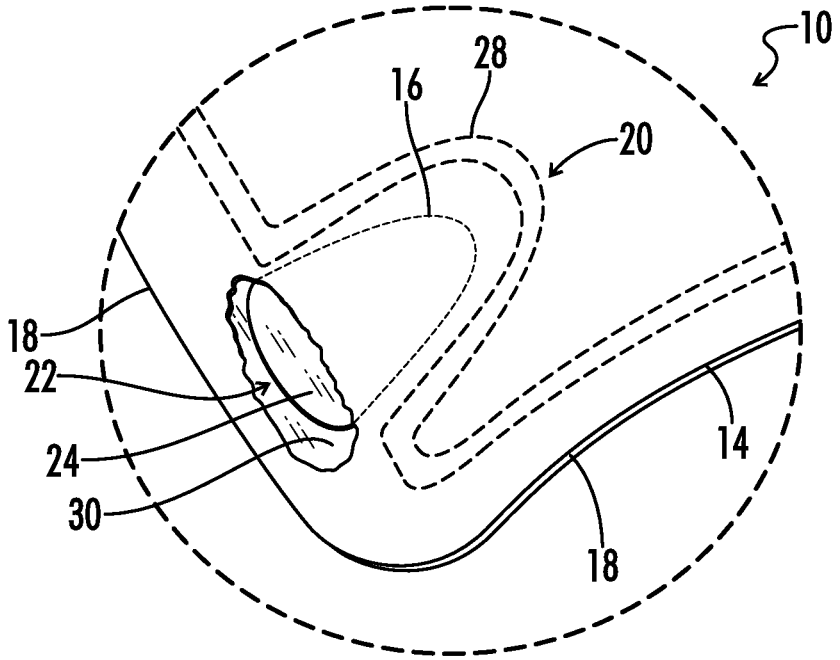
FIG. 4 is a detailed view of a visor pocket of the headwear apparatus shown in FIG. 1 with an object inserted in the visor pocket.

A detailed view of the visor pocket 20 of FIG. 1 is shown in FIG. 3 and FIG. 4. The opening 22 in the outer visor layer 16 can be a slit which can be sized to allow an object 24 to be inserted or slid through the opening 22 and into the visor pocket 20. The size of the opening 22 or slit can be adjusted to accommodate objects 24 of varying sizes. The fastener 28 defines the boundaries of the visor pocket 20. The fastener 28 limits the distance that the object can be inserted into the visor pocket 20 and under the outer visor layer 16, as shown in FIG. 4. Such a limitation can prevent the object 24 from being inserted too far under the outer visor layer 16 and becoming difficult to remove from the visor pocket 20. The fastener 28 can also be configured to define visor pockets 20 of varying shapes and sizes to accommodate objects 24 of various dimensions. For instance, the visor pocket 20 can be defined to accommodate guitar picks, driver's licenses, credit cards, keys, coins, golf markers, golf tees, money, etc.

As can be seen from FIG. 4, when the object 24 is inserted into the visor pocket 20, it is resiliently retained by the outer visor layer 16 between the outer visor layer 16 and the visor 14. The embodiment of FIG. 4 also includes an inner fabric 30 between the outer visor layer 16, and the visor 14, and as such, an object 24 may be resiliently retained between the outer visor layer 16 and the inner fabric 30. In some embodiments, the inner fabric 30 can also include an inner fabric opening, such that an additional object can be inserted between the visor 14 and the inner fabric 30. As such, multiple layered pockets can be formed on the visor 14 which can retain multiple objects 24 on the visor 14. In some embodiments, a portion of the outer visor layer 16 immediately adjacent the opening 22 can be cut back such that when an object 24 is inserted into the visor pocket 20, a portion of the object 24 remains outside of the visor pocket 20 such that the object 24 is accessible and can be quickly grabbed and removed from the visor pocket 20.

Figure 5:
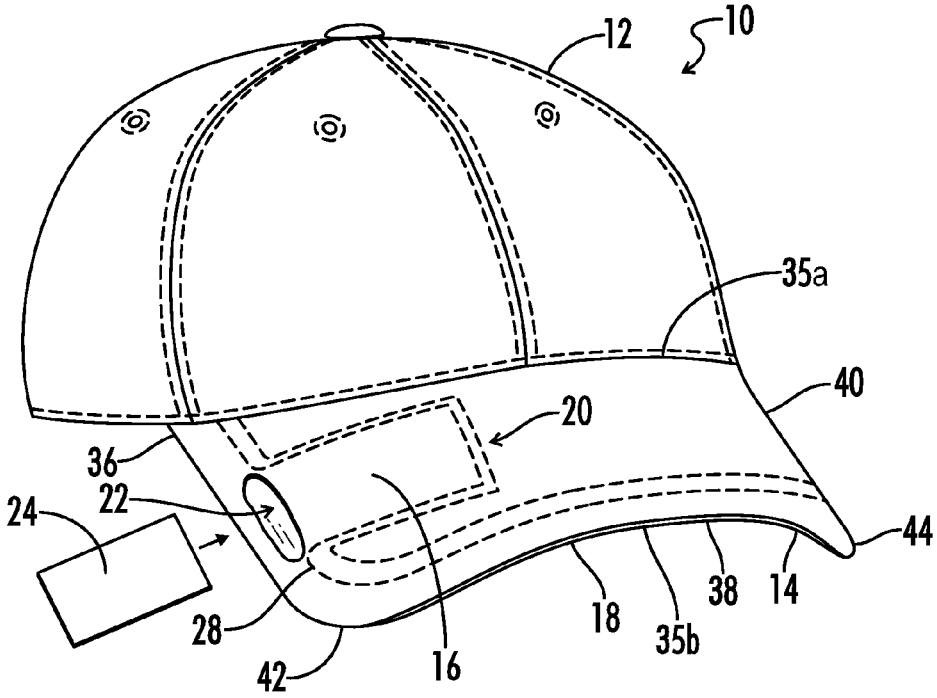
FIG. 5 is a front perspective view of a second embodiment of a headwear apparatus of the present invention.

As can be seen in FIG. 5, the visor 14 can include a proximate end 35*a* mated with the crown 12, and a distal end 35*b* extending away from the crown 12. The outer peripheral edge of the visor 18 can further include a left edge 36, a front edge 38, and a right edge 40. The front edge 38 can be located on the distal end 35*b* of the visor 14 and be defined as the edge generally opposite the proximate end 35*a* of the visor 14. The left edge 36 and the right edge 40 can be located generally adjacent the front edge 38, and the left edge 36 and the right edge 38 can be located generally opposite one another on the visor 14.

Figure 6:
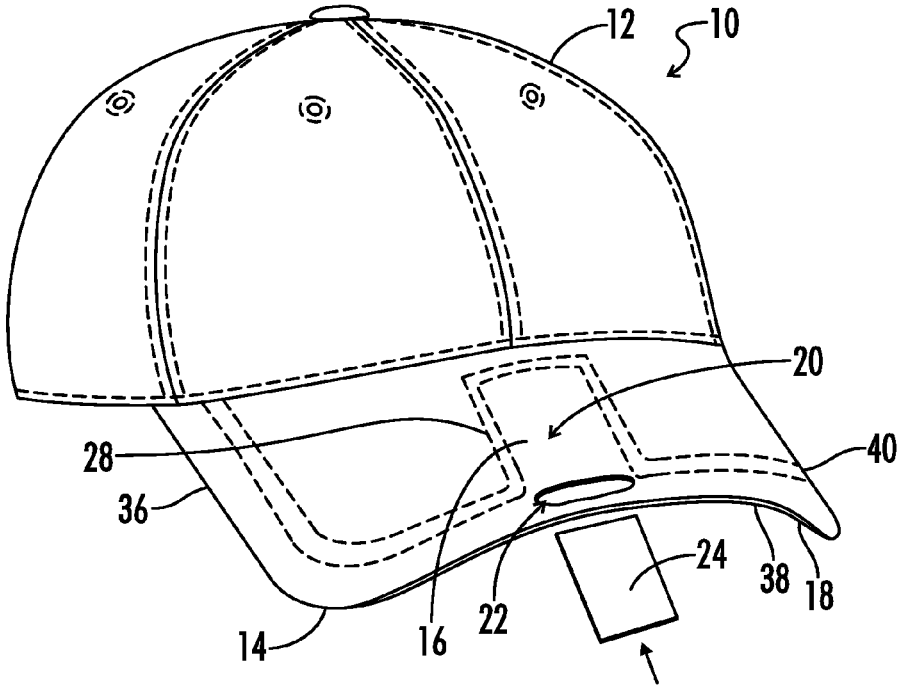
FIG. 6 is a front perspective view of a third embodiment of a headwear apparatus of the present invention.
Figure 7:
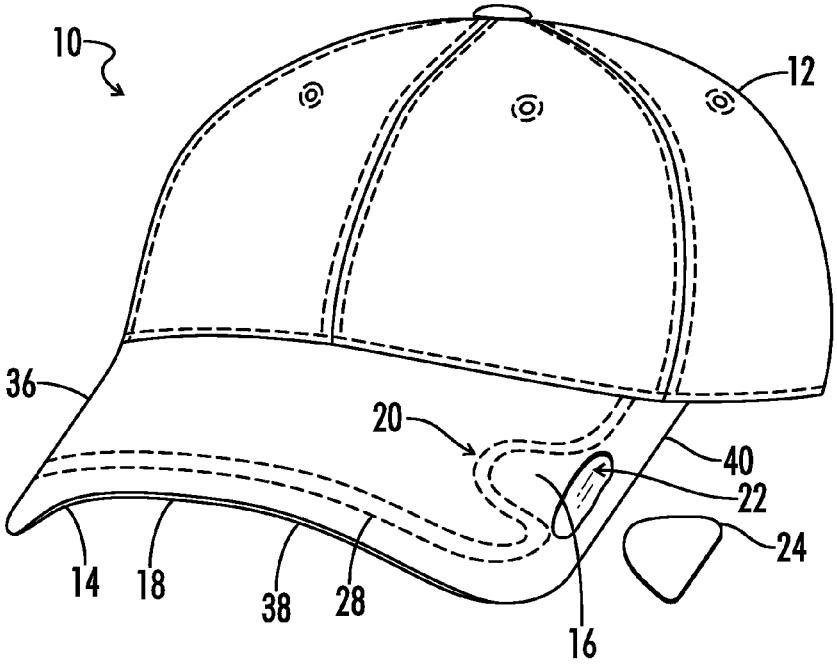
FIG. 7 is a front perspective view of a fourth embodiment of a headwear apparatus of the present invention.

In some embodiments, the visor pocket 20 can be oriented with the opening 22 positioned toward the left edge 36 of the visor 14, as shown in FIG. 1 and FIG. 5. Additionally, the opening 22 and the visor pocket 20 can be located generally proximate to the left edge 36 of the visor 14. In some embodiments, the visor pocket 20 can be oriented with the opening 22 positioned toward the front edge 38 of the visor 14, as shown in FIG. 6. Additionally, the opening 22 and the visor pocket 20 can be located generally proximate to the front edge 38 of the visor. In other embodiments, the visor pocket 20 can be oriented with the opening 22 positioned toward the right edge 40 of the visor 14, as shown in FIG. 7. Additionally, the opening 22 and the visor pocket 20 can be located generally proximate to the right edge 40 of the visor 14.

The ability to adjust the orientation of the visor pocket 20 such that the opening 22 is positioned or directed toward different edges 36, 38, 40 along the outer peripheral edge 18 can allow the headwear apparatus 10 to be tailored to the preferences of the user. For instance, if a user is right-hand dominant, then the user may prefer the visor pocket 20 oriented such that the opening is positioned towards the left edge 36 of the visor 14 such that the user can insert objects more efficiently into the visor pocket 20 with the user's right hand. Similarly, if the user is left-hand dominant, then the user may prefer the visor pocket 20 oriented such that the opening is positioned toward the right edge 40 of the visor 14 such that the user can more efficiently insert objects into the visor pocket 20 with the user's left hand. A visor pocket 20 oriented such that the opening 22 is positioned toward the front edge 38 of the visor 14 can be accessible to both a right-hand dominant and a left-handed-dominant user.

In some embodiments, as shown in FIG. 5, the visor 14 can include a first visor corner 42 formed between the left edge 36 of the visor 14 and the front edge 38 of the visor 14, and a second visor corner 44 formed between the front edge 38 of the visor 14 and the right edge 40 of the visor 14. In such embodiments, the visor pocket 20 can be oriented such that the opening 22 is positioned toward either the first visor corner 42 or the second visor corner 44. Having the visor pocket 20 oriented with the opening 22 positioned toward either of the corners 42 or 44 of the visor 14 can help provide the user with a quick reference point for the location of the visor pocket 20 on the visor 14. In some embodiments, the opening 22 and the visor pocket 20 can additionally be located generally proximate the first visor corner 42 when the visor pocket 20 is oriented with the opening 22 positioned toward the first visor corner 42. In other embodiments, the opening 22 and the visor pocket 20 can additionally be located generally proximate the second visor corner 44 when the visor pocket 20 is oriented with the opening 22 positioned toward the second visor corner 44.

As previously discussed, the visor pocket 20 can be formed in a number of different shapes and sizes. For instance, in FIG. 1, the visor pocket 20 has a generally triangular or semicircular shape. As such, the visor pocket 20 can be used to retain objects 24 including, but not limited to, coins, guitar picks, or golf markers on the visor 14. In other embodiments, as shown in FIG. 5, the visor pocket 20 can have a generally rectangular shape. As such, the visor pocket 20 can be used to retain objects 24 including, but not limited to, credit cards, driver's licenses, and monies on the visor 14. It will be readily apparent to one skilled in the art that the visor pocket 20 can be defined in a variety of different shapes and sizes and be configured to retain a variety of different objects. The shape of the visor pocket 20 is therefore not limited to the shapes and sizes depicted herein.

Figure 8:
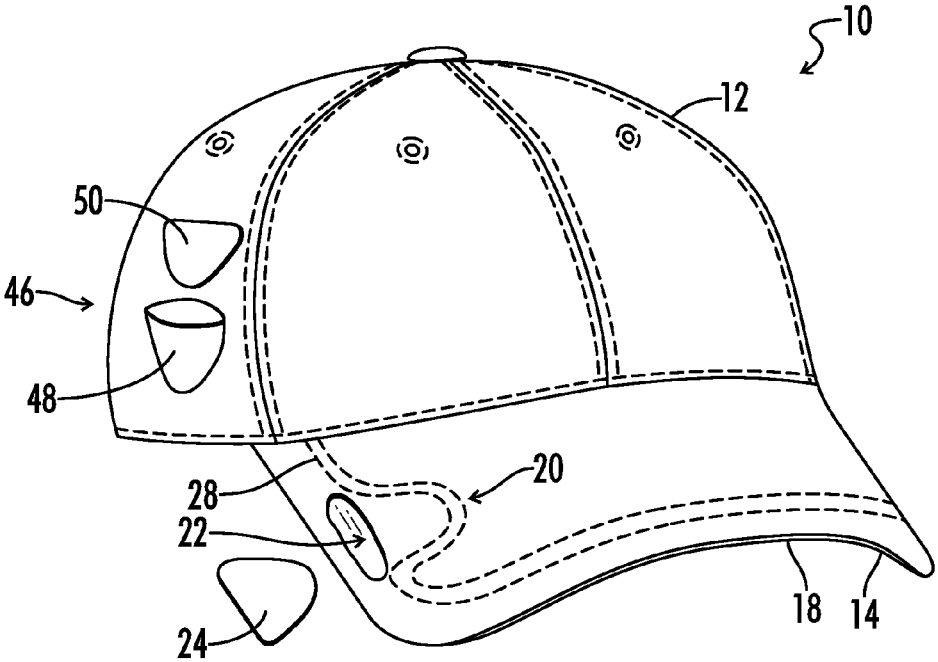
FIG. 8 is a front perspective view of a fifth embodiment of a headwear apparatus of the present invention.

As shown in FIG. 8, in some embodiments the crown 12 can further include a lateral side 46. The headwear apparatus 10 can further include a crown pocket 48. The crown pocket 48 can be built into the crown 12 in some embodiments. In other embodiments, the crown pocket 48 can be a separate fabric sewn onto the crown 12. The crown pocket 48 can be configured to store at least a second object 50, in addition to the object 24 being retained on the visor 14. The crown pocket 48 can also include a closure mechanism including, but not limited to, buttons, zippers, clasps, hook and loop assemblies, or cover flaps, to help secure the at least one second object 50 in the crown pocket 48.

In FIG. 8, the lateral side 46 is located on the left side of the crown 12 when the headwear apparatus 10 is viewed from the front. The crown pocket 48 is then located on the left side of the crown, which can allow right-hand dominant users to efficiently insert a second object 50 into the crown pocket 48. In other embodiments, the lateral side 46 and the crown pocket 48 can be located on the right side of the crown 12. Such a configuration can allow left-hand dominant users to efficiently insert a second object 50 into the crown pocket 48.

In some embodiments, the headwear apparatus 10 can further include a crown opening or slit that can be used to store or hold various objects. In some embodiments, more than one crown opening can be formed on the crown 12. For example, the crown 12 could have an opening on each lateral side 46 generally facing the visor 14 such that the temples or arms of glasses or sunglasses or other objects, such as a golf tee, could be placed in the opening and held securely, for instance when the lenses of the glasses are positioned on the upper surface of the visor 14. As with an opening on the visor 14, the opening on the crown 12 could include a stich surrounding the opening and/or a stich that defines the opening. In another embodiment, there may be multiple openings in each lateral side of the crown. A hollow tube may connect the openings such that objects can be placed, either fully or partially, in a pocket having multiple openings. The openings can face various directions and be configured to hold multiple items such as golf tees, pens, pencils, glasses and sunglasses, etc.

Figure 9:
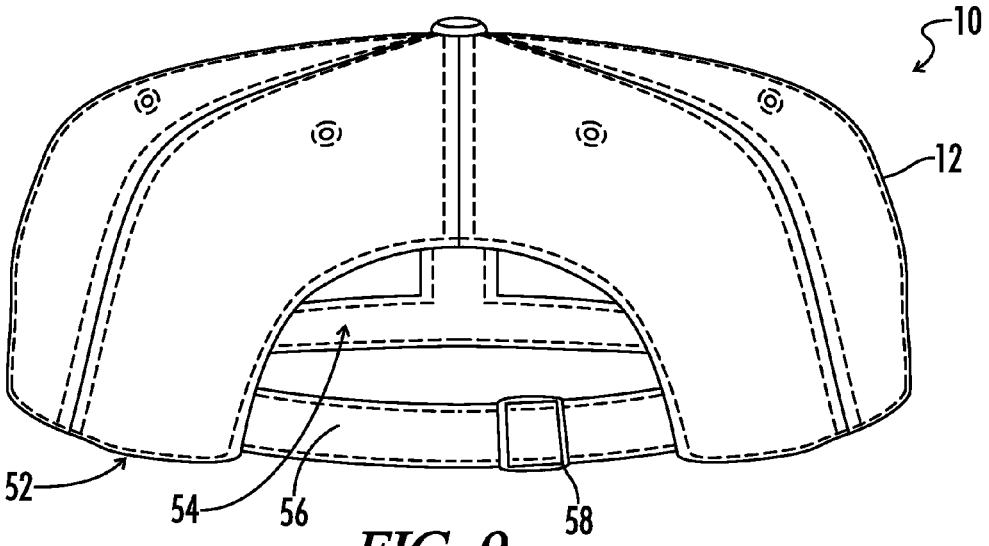
FIG. 9 is a back view of the headwear apparatus shown in FIG. 1.

A view of the back of the headwear apparatus 10 of FIG. 1 is shown in FIG. 9. The back 52 of the crown 12 in some embodiments can include a back opening 54, with an adjustable strap 56 which can be configured to allow users to adjust the length of the adjustable strap 56 to tailor the fit of the crown 12 on the user's head. The strap 56 in some embodiments can include a buckle 58. The adjustable strap 56 can be fed through the buckle 58 to adjust the length of the strap 56, and the fit of the crown 12 on the user's head. In other embodiments, the adjustable strap 56 can include a hook and loop assembly, the hook and loop assembly being utilized to adjust the fit of the crown 12 on the user's head. In other embodiments, the back 52 of the crown 12 does not include any opening or adjustable strap, such that the crown 12 is "fitted" and generally remains the same size.

Figure 10:
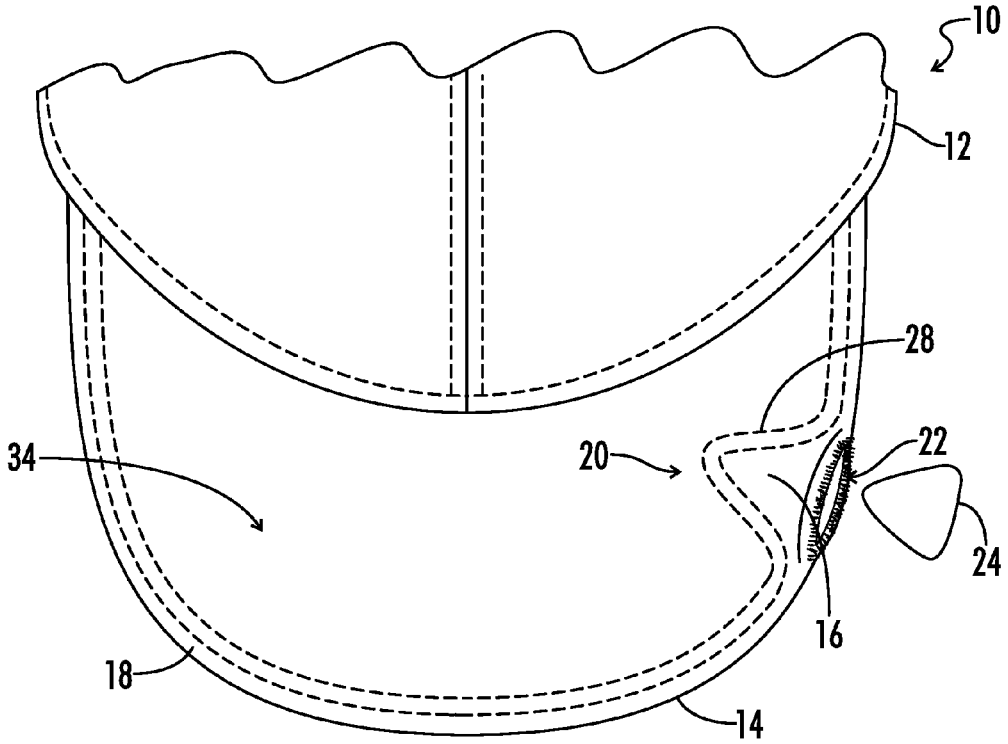
FIG. 10 is a bottom view of a sixth embodiment of a headwear apparatus of the present invention.

A bottom view of another embodiment of the headwear apparatus 10 of the present invention is shown in FIG. 10. In this embodiment, the fastener 28 connects the outer visor layer 16 to the lower surface 34 of the visor 14. As such, the visor pocket 20 is formed adjacent the lower surface 34 of the visor 34 between the lower surface 34 of the visor 14 and the outer visor layer 16. In such a configuration, the user can see the visor pocket 20 in the user's field of vision when the head apparatus 10 is being worn. As such, the user can quickly and efficiently insert an object 24 into the visor pocket 20. An additional benefit of such a configuration is that the upper surface 32 of the visor 34 can retain a conventional look and style of traditional headwear while the headwear apparatus 10 can still offer the benefit of being able to retain objects 24 on the visor 14.

Figure 11:
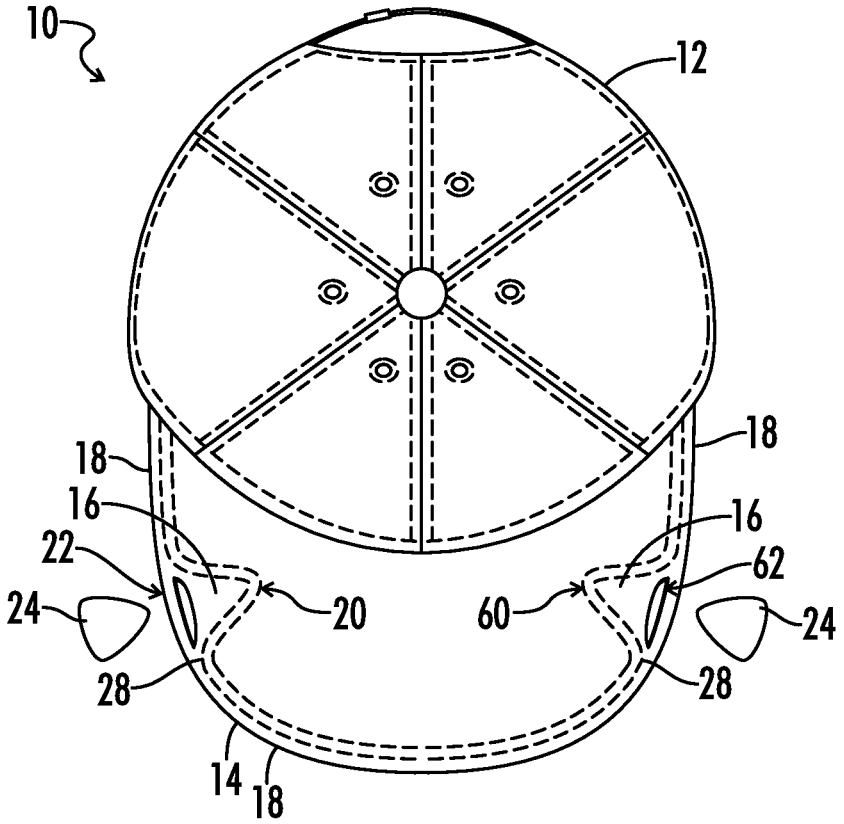
FIG. 11 is a top view of a seventh embodiment of a headwear apparatus of the present invention.

A top view of another embodiment of a headwear apparatus 10 of the present invention is shown in FIG. 11. The headwear apparatus 10 further includes a second visor pocket 60 defined between the outer visor layer 16 and the visor 14. The second visor pocket 60 can include a second opening 62 defined in the outer visor layer 16. The second visor pocket can be oriented such that the second opening 62 is positioned toward the outer peripheral edge 18 of the visor 14. The second visor pocket 60 in some embodiments can be located substantially adjacent to the visor pocket 20. In other embodiments, as shown in FIG. 11, the second visor pocket 60 can be located on an opposite side of the visor 14 from the visor pocket 20. In some embodiments, the fastener 28 can be configured to define both the visor pocket 20 and the second visor pocket 60. Such a configuration allows two or more objects 24 to be retained on the visor 14. The second visor pocket 60 can generally be configured as previously described for visor pocket 20.

Thus, although there have been described particular embodiments of the present invention of a new and useful Headwear With Quick Access Pocket it is not intended that such references be construed as limitations upon the scope of this invention except as set forth in the following claims.

What is claimed is:

1. A headwear apparatus comprising:

a crown;

a visor extending outward from the crown, the visor having an outer peripheral edge;

an outer fabric layer covering at least a portion of the visor;

a fastener connecting the outer fabric layer to the visor; and a visor pocket defined between the outer fabric layer and the visor, the visor pocket including an opening defined in the outer fabric layer, the visor pocket oriented with the opening positioned toward the outer peripheral edge of the visor;

wherein the distance between the outer peripheral edge and the fastener increases along a portion of the outer peripheral edge to define the visor pocket wherein the fastener is a stich that begins from the left of the crown and ends at the right of the crown.

2. The apparatus of claim 1, wherein the visor pocket has a triangular shape.

3. The apparatus of claim 1, wherein the visor pocket has a rectangular shape.

4. The apparatus of claim 1, wherein:

the visor has a proximal end mated with the crown and a distal end extending away from the crown; and the outer peripheral edge of the visor has a front edge, a right edge, and a left edge, the front edge being located on the distal end of the visor, the right edge and the left edge adjoining the front edge, the right edge and the left edge positioned and opposite one another on the visor.

5. The apparatus of claim 4, wherein the visor pocket is oriented with the opening positioned toward the right edge of the visor.

6. The apparatus of claim 4, wherein the visor pocket is oriented with the opening positioned toward the left edge of the visor.

7. The apparatus of claim 4, wherein the visor pocket is oriented with the opening positioned toward the front edge of the visor.

8. The apparatus of claim 1, wherein the visor further comprises a textured outer surface.

9. The apparatus of claim 1, further comprising an inner fabric located between the outer fabric layer and the visor, the inner fabric located within the visor pocket.

10. The apparatus of claim 1, wherein the outer fabric layer is elastic, and the outer fabric layer is stretched to cover the visor, the outer fabric layer thereby being resilient to deformation when an object is inserted through the opening.

11. The apparatus of claim 1, further comprising a second visor pocket defined between the outer fabric layer and the visor, the second visor pocket including a second opening defined in the outer fabric layer, the second visor pocket oriented with the second opening positioned toward the outer peripheral edge of the visor.

12. A headwear apparatus comprising:

a crown;

a visor extending outward from the crown, the visor having an upper surface and an outer peripheral edge;

an outer fabric covering at least a portion of the upper surface of the visor;

a fastener located between the crown and the outer peripheral edge connecting the outer fabric to the visor, and a visor pocket defined between the upper surface of the visor and the outer fabric, the visor pocket including an opening defined in the outer fabric, the visor pocket oriented with the opening positioned on the visor outward from the fastener and toward the outer peripheral edge of the visor wherein, the fastener is a stich that begins from the left of the crown and ends at the right of the crown.

13. The apparatus of claim 12, wherein the opening for the visor pocket is located contiguous to the outer peripheral edge of the visor.

14. The apparatus of claim 12, wherein, the stich is curving away from the outer peripheral edge and toward the crown to an apex and then curving away from the crown and toward the outer peripheral edge to define the visor pocket.

15. A headwear apparatus comprising:

a crown;

a visor extending outward from the crown, the visor having an outer peripheral edge;

an outer visor layer covering at least a portion of the visor;

a fastener formed between the crown and the outer peripheral edge connecting the outer visor layer to the visor, a portion of the fastener indented away from the outer peripheral edge, the portion of the fastener defining a visor pocket between the outer visor layer and the visor; and an opening defined in the outer visor layer formed between the indented portion of the fastener and the outer peripheral edge, the opening extending into the visor pocket, the visor pocket oriented with the opening positioned outward from the fastener and toward the outer peripheral edge of the visor wherein, the fastener is a stich that begins from the left of the crown and ends at the right of the crown.

* * * * *